United States Patent [19]

Salomon

[11] 4,112,557

[45] Sep. 12, 1978

[54] DEVICES FOR FASTENING SKI BOOTS

[75] Inventor: Georges Pierre Joseph Salomon, Annecy, France

[73] Assignee: S.A. des Etablissements Francois Salomon & Fils, Annecy, France

[21] Appl. No.: 826,941

[22] Filed: Aug. 19, 1977

[30] Foreign Application Priority Data

Sep. 7, 1976 [FR] France ..... 76 26829

[51] Int. Cl.[2] ..... A43C 11/14

[52] U.S. Cl. ..... 24/69 SK; 24/70 SK; 36/50

[58] Field of Search ..... 24/68 SK, 70 SK, 71 SK, 24/735 G, 81 SK, 69 SK; 36/50

[56] References Cited

U.S. PATENT DOCUMENTS

| | | | |
|---|---|---|---|
| 3,292,222 | 12/1966 | Steinberg | 24/68 SK |
| 3,363,288 | 1/1968 | Lange et al. | 24/68 SK |
| 3,521,330 | 7/1970 | Steinberg | 24/70 SK |
| 4,051,611 | 10/1977 | Chalmers | 36/50 |

FOREIGN PATENT DOCUMENTS

| | | | |
|---|---|---|---|
| 245,434 | 6/1965 | Austria | 24/68 SK |
| 1,366,146 | 6/1964 | France | 24/70 SK |

*Primary Examiner*—Louis K. Rimrodt

*Attorney, Agent, or Firm*—Haseltine, Lake & Waters

[57] ABSTRACT

A device for fastening a ski boot is characterized in that it comprises a second unlocking lever having a positive action, pivoted to the rack or clamping lever and whose pivotal movement causes the disengagement of the engagement pin of the clamping lever from the notch of the rack in which this pin was housed.

14 Claims, 16 Drawing Figures

IV
IV
13
12
6
7
11
14
10
9'
2
3
8
9
1
4
4a
5

VII
VII
35
34
32
34'
26
31
27
30
36
29'
37
24
2
33'
29
28
23'
25
33
1

FIG. 10
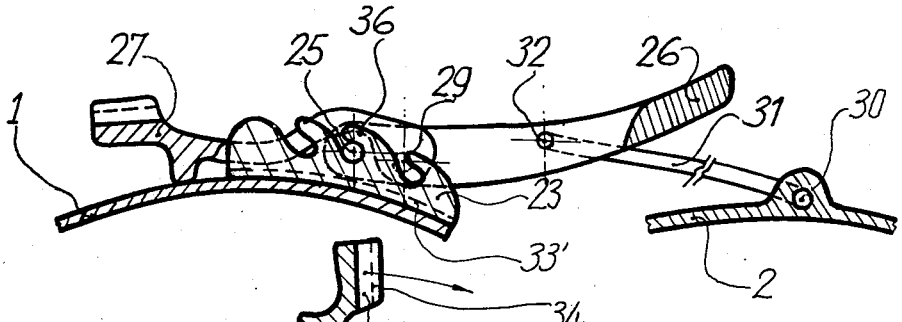
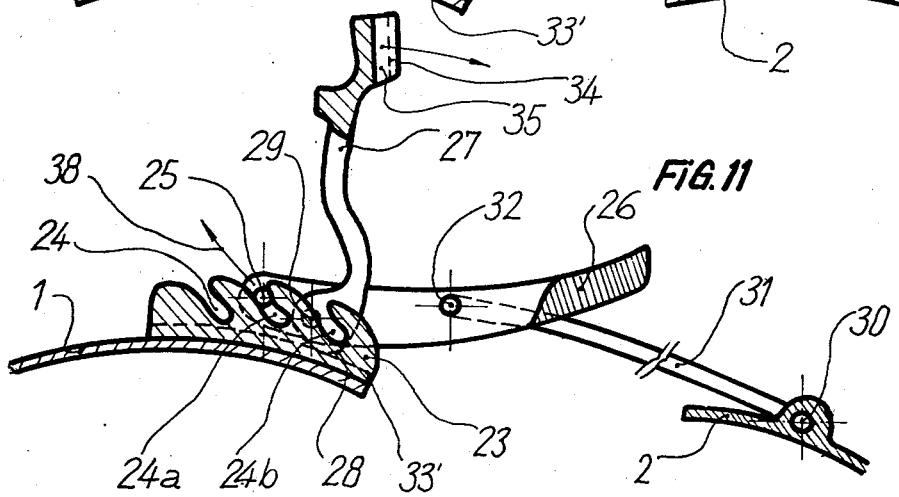
FIG. 11
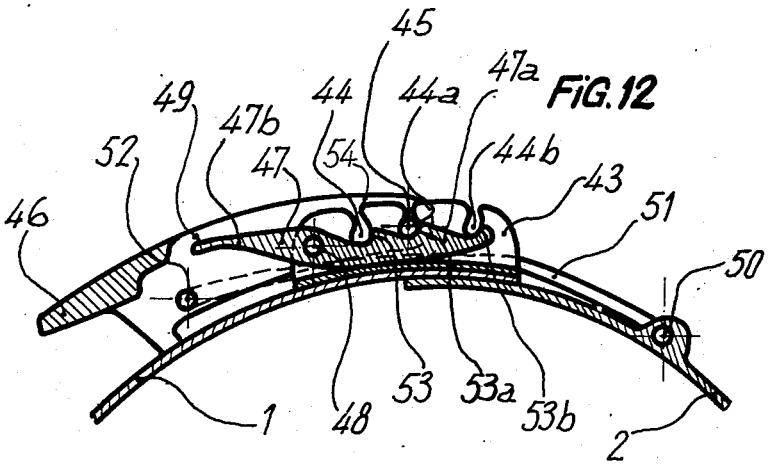
FIG. 12

DEVICES FOR FASTENING SKI BOOTS

The present invention relates to a device for fastening a ski boot.

Existing ski boots all comprise fastening devices using hooks or quick-release clips, which allow fastening and a more or less effective clamping of said boot on the foot. The function ensured by the opening of these hooks is just as important. In fact, not only should removal of the boot be facilitated by the latter, but also the skier should have the ability to walk as easily as possible or even to stand upright in an anatomically normal position during the periods of time spent queueing for mechanical ski lifts. However, it is particularly advantageous for the skier to be able to retain the adjustment of the clamping of his boot despite opening the latter successively after many descents. From this point of view, the fastening device should be designed in order to facilitate slackening of the boot without allowing either upsetting of the clamping, or removal of the foot from the latter. Fastening devices are already known, with which attempts have been made to resolve this problem. These devices all have various drawbacks, such as:

- incomplete opening in the case of boots having a rear opening,
- the necessity of manual re-tightening of the two edges of the boot when it is fastened, requiring both hands for the operation,
- inopportune release of the hooks when they are no longer under clamping tension, thus eliminating any retention of the foot in the boot when walking.

The present invention intends to obviate the said drawbacks. To this end, this fastening device of the toggle type for a ski boot, for drawing the two edges of said boot together, comprising a rack fixed to a first edge of the boot and comprising at least one notch, a clamping lever integral with an engagement pin also constituting a pivot pin for the lever engaging in said notch of said rack and a traction member pivoted firstly on the second edge of the boot and secondly on the clamping lever, the latter being able to occupy a first position when it is closed flat on the boot, a second stable intermediate position for walking or partial opening and a third position of complete opening in which the engagement pin is disengaged from the notch, is characterised in that it comprises a second unlocking lever having a positive action, pivoted on the rack or clamping lever and whose pivotal movement causes the removal of the engagement pin of the clamping lever from the notch of the rack in which this pin was housed.

In the fastening device or hook according to the invention, the two separate levers have the feature of facilitating a released position produced by the clamping lever ensuring partial opening of the boot, the hook nevertheless remaining engaged in a notch of the rack and an unlocked position produced by the second lever ensuring removal of the hook from the rack and consequently complete opening of the boot.

According to a preferred embodiment, the hook is composed of two coaxial levers, their pivot pin also acting as an engagement pin in the rack, means being provided on one of the latter (arms comprising a cam) for unlocking the arrangement from said rack.

According to another embodiment, the hook is composed of two levers mounted one on the other, their pivot pin being separate.

Finally, according to another possible variation, one of the levers (the unlocking lever for example) is mounted and integrated in the rack, the other lever composing the hook proper.

The following description, referring to the accompanying drawings, given as a non-limiting example, will make it easier to understand the invention.

FIG. 10 is a sectional view on line VII—VII of the hook of FIG. 2 shown in a given position of partial opening, only one of the levers participating in the release, the other remaining in the locked position.

FIG. 11 is a sectional view on line VII—VII of the hook of FIG. 2, shown in the course of complete unlocking, the released lever being in the course of being disengaged from the rack by the action of the other lever pivoted to the former by a pin offset with respect to the engagement pin.

FIG. 12 is a sectional view on line XII—XII of the hook of FIG. 3, shown in the closed position.

Figure 1:
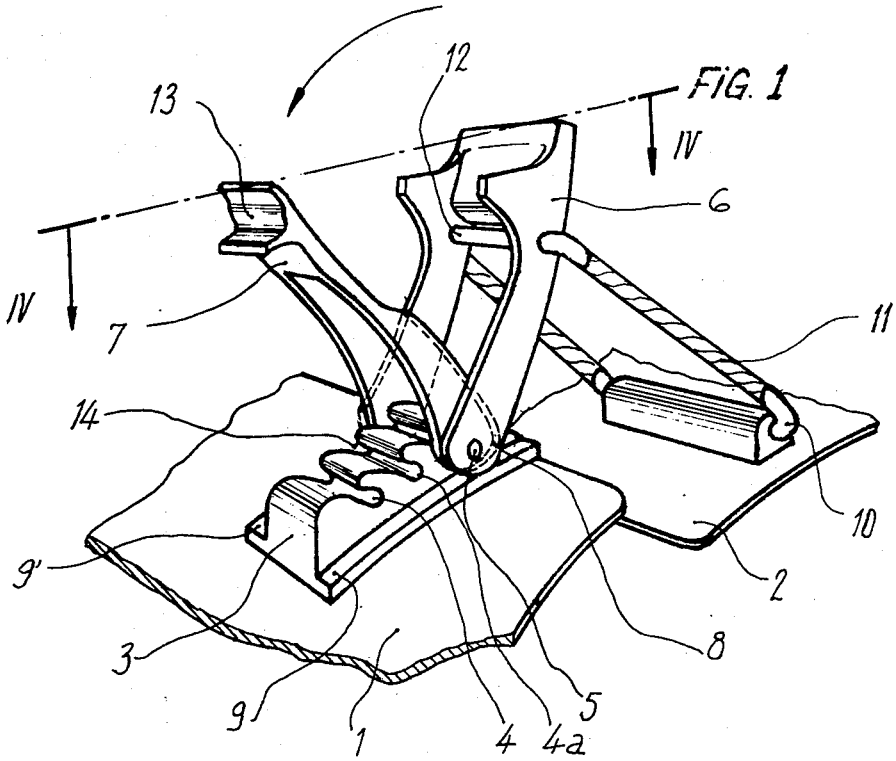
FIG. 1 is a perspective view of a preferred embodiment of the hook according to the invention.

FIGS. 1, 4, 5 and 6 show a fastening device or hook according to the invention in the various closing and opening positions acting on the edges 1 and 2 of a boot.

The fastening device described is of the toggle type. It comprises two levers in the shape of stirrups comprising two parallel sides, namely a clamping lever 6 and an unlocking lever 7, which are mounted coaxially one in the other on a common pivot pin 5 which passes through adjacent end parts of the parallel sides of the two levers 6 and 7. The device also comprises a traction member 11 of flexible material (such as a cable etc.), fixed, at one of its ends, to the edge 2 of the boot, through the intermediary of a pivot pin 10 and, at its other end, to the clamping lever 6, through the intermediary of a pivot pin 12 located in the central part of this lever 6. The fastening device also comprises a rack 3 which is integral with the other edge 1 of the boot, being connected to the latter or moulded therewith. The pivot pin 5 common to the two levers 6 and 7 acts as an engagement pin thus making it possible to fix the clamping lever 6 on the rack 3, which comprises several notches 4, 4*a*, 4*b*, in one of which the engagement pin 5 is engaged depending on the tension chosen for the fastening of the boot.

By rotating the clamping lever 6 in counter-clockwise direction (indicated by the arrow in FIG. 1), then, consequently, by rotation of the unlocking lever 7 in this same direction, about the engagement pin 5, housed in one of the notches of the rack, the edges 1 and 2 are drawn together and the fastening of the boot is thus ensured.

The unlocking lever 7 itself pivots with respect to the clamping lever 6 owing to the common pin 5 and in the region of this pin 5, it comprises a part 8 which is eccentric with respect to the pin 5 (for example in the shape of a cam), on the end part of each of its parallel sides.

Figure 6:
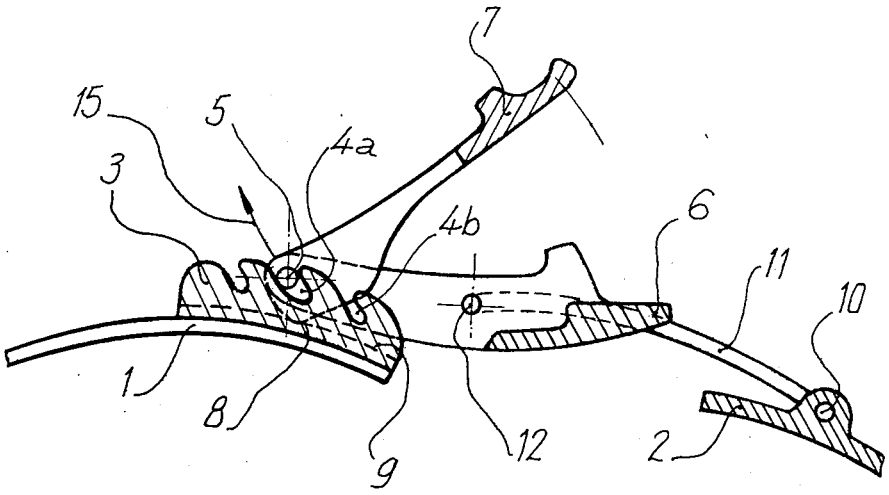
FIG. 6 is a sectional view on line IV—IV of the hook of FIG. 1, shown in the course of complete unlocking, the released lever being in the course of being disengaged from the rack by the action of the other lever which is coaxial to the former.
Figure 7:
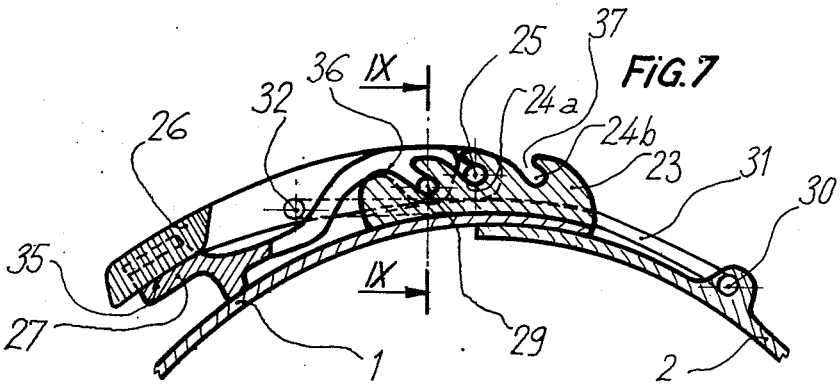
FIG. 7 is a sectional view on line VII—VII of the hook of FIG. 2, shown in the closed position.
Figure 8:
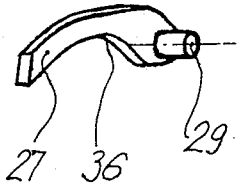
FIG. 8 is a perspective view of a detail of the unlocking arm or lever showing the configuration of the pivot serving as a pivot pin in the hook of FIG. 7.
Figure 9:
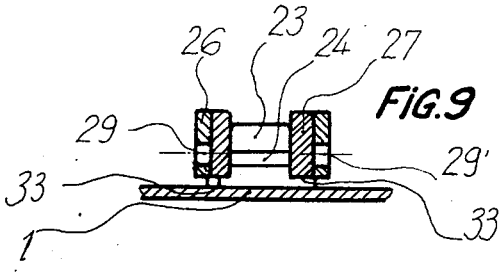
FIG. 9 is a sectional view on line IX—IX of FIG. 7 showing the engagement of the pivot pins of the unlocking lever in the clamping lever.

It is possible to observe various stages of the operation of the levers, pivoting in clockwise direction, thus facilitating the passage from the closed position (FIG. 4), to that of partial opening (FIG. 5), then finally to that of complete opening (FIG. 6).

Thus, starting from the fastened position (FIG. 4) in order to reach the position of partial opening (FIG. 5), also referred to as the stable walking position, since it facilitates walking or an anatomically normal upright stance, whilst retaining the foot correctly in the boot as well as the engagement pin 5 in one of the notches 4, 4*a*, 4*b* chosen according to the desired adjustment of tension, one carries out a rotation of the clamping lever 6 in clockwise direction, about the engagement pin 5, which causes a release of the traction member 11, hence a separation of the edges 1, 2 of the boot assisting walking. Owing to the fact that the unlocking lever 7 is pivoted freely on the clamping lever 6, this unlocking lever remains in the closed position, in which it is supported on the edge 1 of the boot, the common engagement pin 5 always remaining engaged in the chosen notch (for example 4*a*) of the rack. The released stable position is thus obtained.

To disengage the clamping lever 6 from the rack 3, a stage corresponding to passage into the completely open position (FIG. 6), the unlocking lever 7 is thus operated by bringing about a rotation of this lever in clockwise direction, about the engagement pin 5, until the edges of the cams 8 come to bear against the side surfaces 9, 9' of the rack. By continuing the rotary movement of the unlocking lever 7 in the same direction, the eccentric cams 8, rolling and sliding on the abutment surfaces 9, 9', thus cause the disengagement of the engagement pin 5 from the notch 4*a*, owing to the continuous movement due to the shape of the cams 8. When the pin 5 is thus disengaged from its notch 4*a*, complete opening of the boot is achieved.

Figure 4:
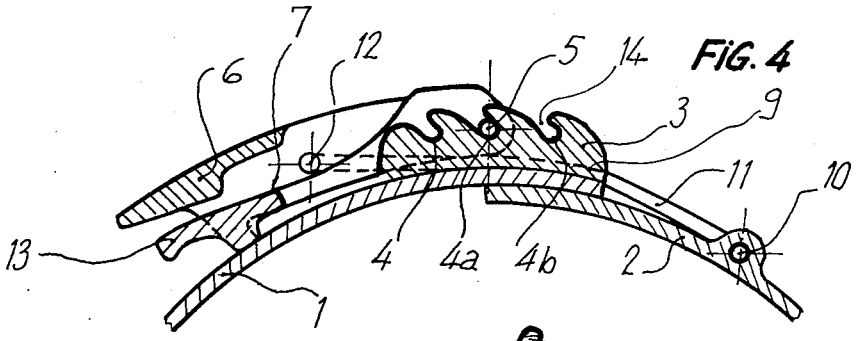
FIG. 4 is a sectional view on line IV—IV of the hook of FIG. 1, shown in the closed position.
Figure 5:
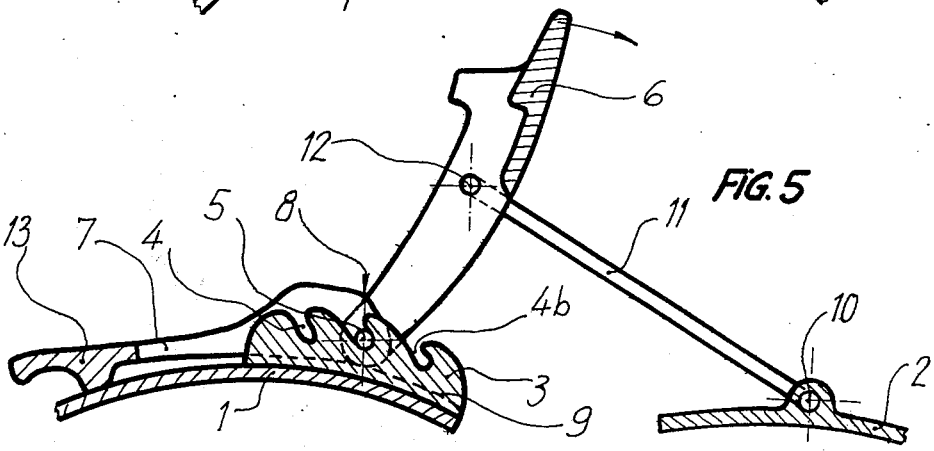
FIG. 5 is a sectional view on line IV—IV of the hook of FIG. 1, shown in a given position of partial opening, one of the levers participating solely in the release, the other remaining in the locked position.

As can be seen in FIG. 4, in the fastened position, the unlocking lever 7 is covered by the clamping lever 6, but its movable end 13 which constitutes the core of the movable stirrup member is accessible from outside, such that if the skier wishes to pass directly to the position of complete opening, it is possible for him to pivot the unlocking lever 7 through approximately 180° in clockwise direction, without stopping at the intermediate position of partial opening. During this movement, the unlocking lever 7 entrains the clamping lever 6 in the same direction, due to contact of the lever 7 with the pivot pin 12 of the traction member 11 and/or with the moving end of the clamping lever 6.

FIGS. 2, 7, 8, 9, 10 and 11 show a variation of a hook according to the invention, which differs from that shown in FIG. 1 by the fact that the clamping lever 26 and unlocking lever 27, in the shape of stirrups having parallel sides, pivoted one in the other, have separate pivot pins, 25 and 29, 29' respectively. As previously, the pin 25 of the clamping lever 26 which extends between the end parts of the two sides of the lever, also acts as an engagement pin engaged in one of the notches 24, 24*a*, 24*b* of a rack 23 fixed to the first edge 1 of the boot. The clamping lever 26 is connected to a traction member 31 of flexible material through the intermediary of a pivot pin 32, this traction member 31 also being pivoted to the second edge of the boot, through the intermediary of a pin 30.

The two sides of the locking lever 27 are pivoted respectively to the two adjacent sides of the clamping lever 26 through the intermediary of two coaxial and lateral lugs 29, 29', which are engaged in respective coaxial holes provided in the two sides of the clamping lever 26. However, owing to the centre-to-centre distance between the pivots 25 on the one hand and 29, 29' on the other hand, the shape of the eccentrics 28 (shape of the cam) provided at the ends of the two sides of the unlocking lever 27 and the shape of the sides of this lever are consequently modified in order to facilitate the various closing and opening positions in a functional manner. Thus, the shape of the cams 28 comprises a larger contour taking into account the centre-to-centre distance between the pivot pins 25 and 29, 29'. These cams 28 co-operate with lateral abutment surfaces 33, 33' of the rack 23, in order to remove the pin 25 from its notch.

Furthermore, the sides of the lever 27 may each comprise a recess 36 enabling said lever 27 to retain a flat closed position at the time of the position of partial opening of the hook (FIG. 10), owing to the fact that the pin 25 is housed in this recess 36. Finally, for reasons of bulk, the pivot pin for the unlocking lever 27 on the clamping lever 26 is preferably constituted by two coaxial lugs 29, 29' connected thereto or cast therewith, thus facilitating easier assembly of the unlocking lever 27 on the clamping lever 26 (see FIGS. 8 and 9).

In order to facilitate actuation of the unlocking lever 27, the latter preferably comprises, at its moving end, two lateral lugs 34, 34' and a central recess 35 between these lugs, where the movable end part of the clamping lever 26 is housed, thus allowing a simultaneous actuation of the two levers if necessary. From this point of view, it is clear that one could use a lever of this type in the embodiment of FIG. 1.

To obtain the various positions, one carries out the same movements as in FIG. 1, with the levers 26 and 27.

FIGS. 3, 12, 13, 14 show a variation of the embodiment of the hook according to the invention in the various closing and opening positions, acting on the edges 1 and 2 of a boot.

The device described still relates to a toggle fastening. However, in contrast to the other embodiments described, the unlocking lever 47 is no longer pivoted to the clamping lever 46, but on the other hand, to the rack 43, which comprises notches 44, 44*a*, 44*b* in one of which the pivot pin 45 engages, acting as the engagement pin of said clamping lever 46.

The rack 43 is no longer solid, as in the case of the embodiments afore-described, but on the contrary, it is in the shape of a profiled member of U-shaped cross section. This profiled member is connected by its core to the first edge 1 of the boot and the lever 47 which is pivoted to the rack 43 about a transverse pin 48 close to the end of the rack remote from the second edge 2, comprises an inner arm 47*a* housed between the two sides of the rack 43 and under the engagement pin 45 and an outer arm 47*b* extending the former.

Figure 2:
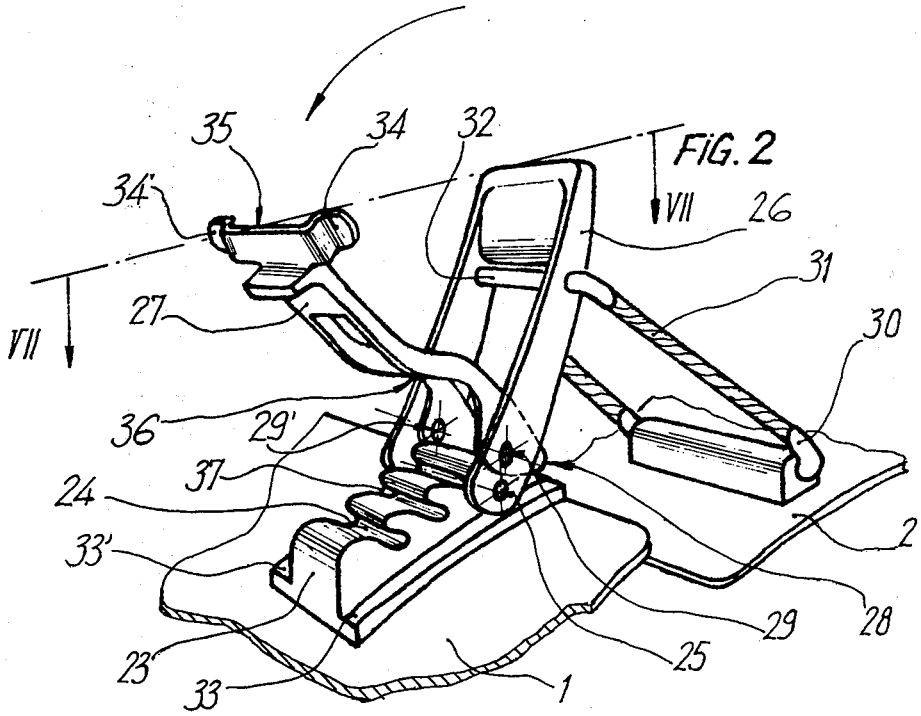
FIG. 2 is a perspective view of a variation of the hook according to the invention.
Figure 3:
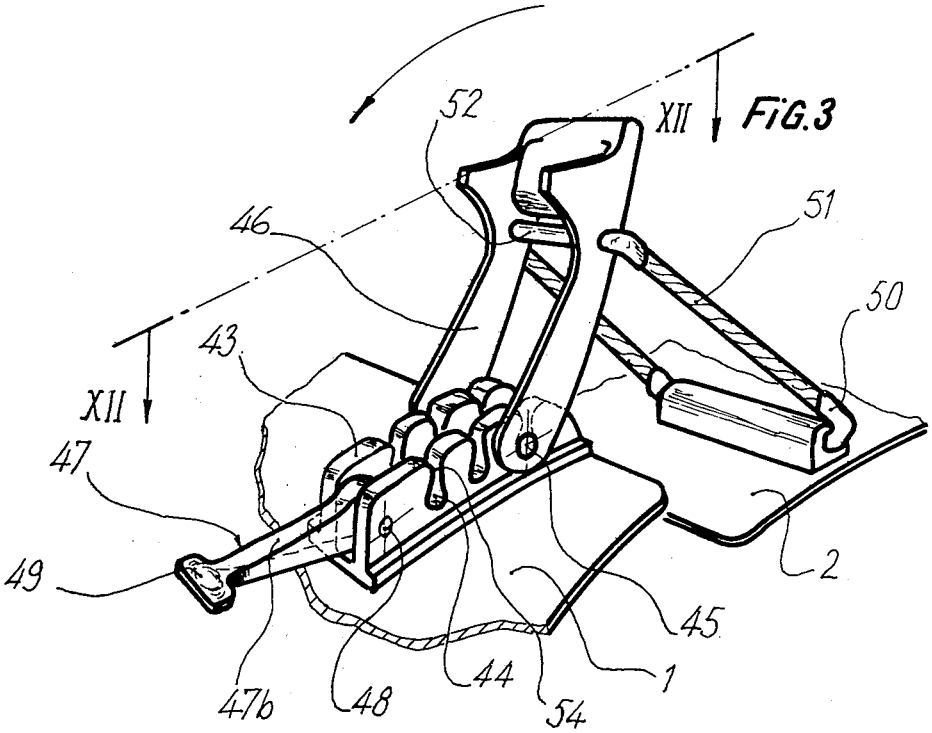
FIG. 3 is a perspective view of another variation of the hook according to the invention.

As in the case of the embodiments shown in FIGS. 1 and 2, the fastening device comprises a traction member 51 which is pivoted firstly to the clamping lever 46, by means of a pin 52 and secondly to the second edge 2 of the boot, by means of a pin 50.

Figure 13:
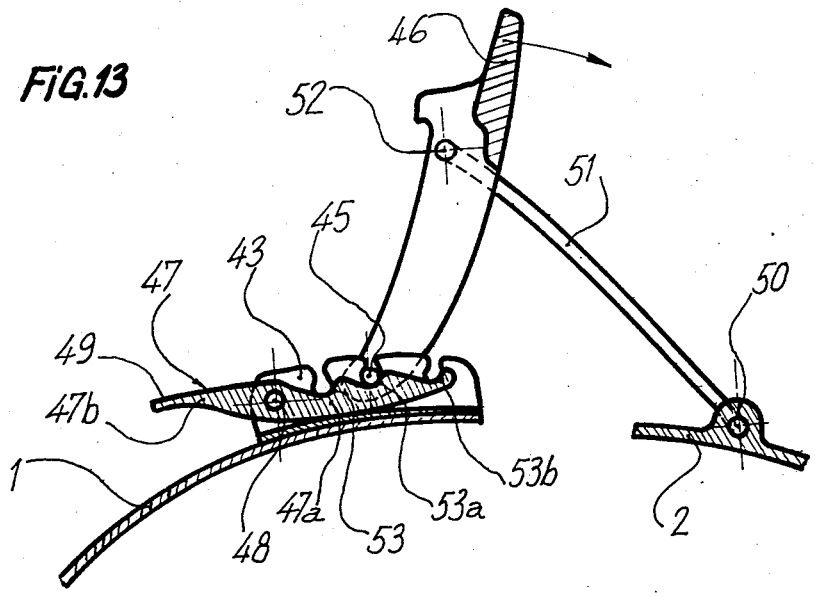
FIG. 13 is a sectional view on line XII—XII of the hook of FIG. 3 shown in a given position of partial opening, only one of the levers participating in the release, the other remaining in the locked position.
Figure 14:
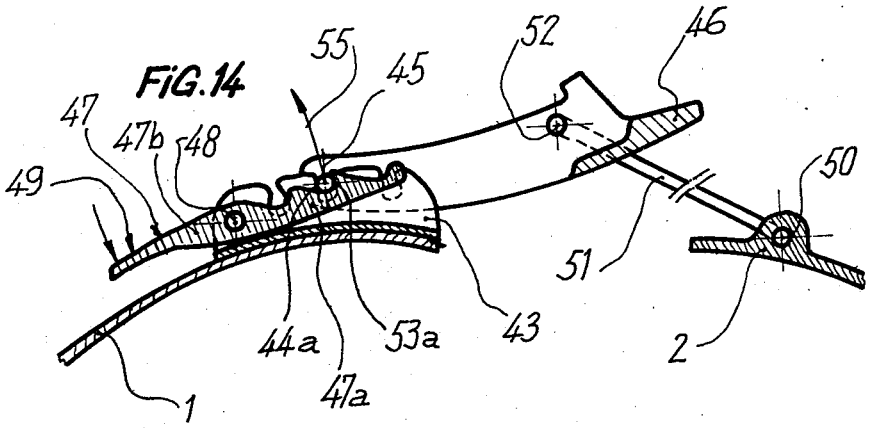
FIG. 14 is a sectional view on line XII—XII of the hook of FIG. 3, shown in the course of complete unlocking, the released lever being in the course of being disengaged from the rack by the action of the other lever pivoted to said rack.

On the upper side of its inner arm 47*a*, the unlocking lever 47 comprises notches 53, 53*a*, 53*b* corresponding respectively to the notches 44, 44*a*, 44*b*, such that when one presses on the end 49 of the outer arm 47*b* of the lever 47, the latter pivots in counter-clockwise direction in FIGS. 13 and 14, the inner arm 47*a* is raised and one of the notches 53, 53*a*, 53*b* is engaged under the engagement pin 45 in order to raise the latter then disengage it from the notch in which it was located (FIG. 14).

Figure 15:
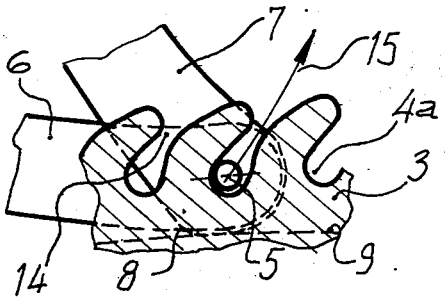
FIGS. 15 and 16 show the detail of the openings of the notches of two different types of rack.
Figure 16:
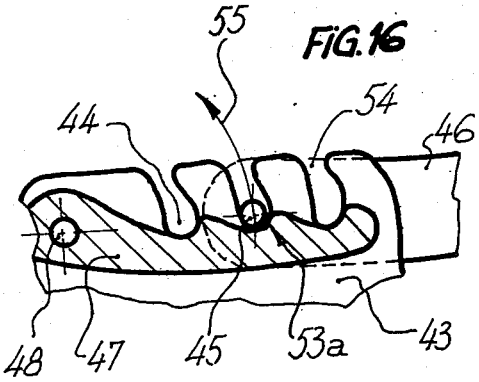

It should be noted that in the various embodiments proposed, the connection of the clamping lever 6, 26, 46 to the rack 3, 23, 43 is achieved by means of notches whose entrance 14, 37, 54 has a section less than that of the engagement pin 5, 25, 45 penetrating the latter (FIGS. 15 and 16).

Furthermore, the rack is made from a material which is able to undergo temporary elastic deformation. Due to this, the engagement pin may be engaged in a notch by force, thus temporarily enlarging the section of the opening and it then remains trapped in the base of the notch after the return of the section of the opening to its initial dimension.

One thus obtains locking of the hook, preventing the latter from opening inopportunely in the partial opening position. In addition, the access ramp of the notches is arranged in order to facilitate disengagement of the engagement pin 5, 25, 45 along the trajectory 15, 38, 55 imparted to this pin by the unlocking lever 7, 27, 47 (FIGS. 15 and 16).

Finally, in the particular case of the embodiment of FIG. 1, in order to prevent any incorrect locking of the clamping lever 6, an abutment device is provided on the unlocking lever 7, which prevents said lever 7 from carrying out a complete rotation about the pivot pin 5, which thus makes it possible to draw the skier's attention to the necessity of restoring the locking lever 7 to the combined position with the clamping lever 6 in order to be able to bring about correct locking in the rack 3. From the point of view of correct operation of the hooks according to FIGS. 1 and 2 by the skier and in order to compel the latter to lock the hook correctly in the rack, a positioning system (springs) may be provided, ensuring a position for clipping the levers 6, 26 in a notch of the rack.

It is obvious that the invention may be used in several cases, for boots opening at the front or rear. It may also be used advantageously for tensioning two ends of attachment means of a system for retaining the foot inside a boot.

What is claimed is:

1. A fastening device for a ski boot comprising a toggle for drawing two edges of said boot together and including a rack for fixing to a first edge of the boot and having at least one notch, a clamping lever integral with an engagement pin also constituting a pivot pin for the lever engaging in said notch of said rack, a traction member pivoted, on the one hand, to a second edge of the boot and, on the other hand, to the clamping lever, the latter being able to occupy a first position in which it is closed flat on the boot, a second stable intermediate walking position, or position of partial opening and a third position of complete opening in which the engagement pin is released from the notch, and an unlocking lever having a positive action, pivoted on the rack or clamping lever, and whose pivotal movement causes the removal of the engagement pin of the clamping lever from the notch of the rack in which this pin was housed.

2. A fastening device according to claim 1, in which, where the unlocking lever is pivoted to the clamping lever means are provided on the unlocking lever for removing the engagement pin from one of the notches of the rack at the time of the pivotal movement of the unlocking lever.

3. A fastening device according to claim 2, in which the means provided on the unlocking lever for removing the engagement pin from the notch of the rack comprise an eccentric pivoting about the pivot pin of the unlocking lever on the clamping lever, this eccentric coming to bear against a surface of the rack at a certain time during the pivotal movement of the unlocking lever.

4. A fastening device according to claim 2 in which the pivot pin of the unlocking lever is combined with the pivot pin of the clamping lever and at the same time constitutes the engagement pin of the rack.

5. A fastening device according to claim 2, in which the pivot pin of the unlocking lever is separate from the pivot pin of the clamping lever constituting the pin for engaging in the rack.

6. A fastening device according to claim 5, in which the pivot pin of the unlocking lever is formed by two coaxial and lateral lugs on either side of said lever, which are engaged, by the inside or outside, in coaxial holes provided in the clamping lever.

7. A fastening device according to claim 2, in which the clamping lever and the unlocking lever are constituted by two stirrup members having two parallel sides, engaged one in the other and pivoted one to the other in the region of the end parts of the parallel sides, the cores of the two stirrup members located opposite the pivot pin constituting gripping means for actuating the two levers.

8. A fastening device according to claim 7, in which, in the case where the pivot pin of the clamping lever is separate from the pivot pin of the unlocking lever on the clamping lever, the unlocking lever comprises, on each of its parallel sides, a recess enabling said lever to retain a flat closed position, in the position of partial opening, owing to the fact that the pivot pin is housed in the recesses.

9. A fastening device according to claim 2, in which the unlocking lever comprises means facilitating a simultaneous actuation of the clamping lever in order to reach the position of complete opening without passing through the intermediate position of partial opening.

10. A fastening device according to claim 9, in which the unlocking lever comprises, at its movable end, two lateral lugs and a central recess (35) between these lugs in which the movable end part of the clamping lever (26) is housed, in the closed position.

11. A fastening device according to claim 1, in which, in the case where the unlocking lever is pivoted on the rack, this rack has the shape of a profiled member of U-shaped cross section and the lever which is mounted to pivot about a transverse pin adjacent the end of the rack remote from the second edge of the boot, comprises an inner arm housed between the two sides of the rack and under the engagement pin of the clamping lever and an outer arm extending the former.

12. A fastening device according to claim 11, in which the unlocking lever comprises, on the upper side of its inner arm notches corresponding respectively to the notches of the rack in order to facilitate engagement under the engagement pin at the time of its disengagement from the notch of the rack.

13. A fastening device according to claim 1, in which the rack comprises notches whose opening and access ramp are arranged in order to facilitate disengagement of the engagement pin along the trajectory imparted by the unlocking lever.

14. A fastening device according to claim 1, in which the section of the opening of the notches of the rack is less than the section of the diameter of the engagement pin and the rack is made from a material allowing a temporary deformation of the opening section of the notch, at the time of passage of the engagement pin in this area, in order to ensure elastic locking of the engagement pin in the bottom of the notch.

* * * * *